US006978602B2

(12) United States Patent
Ohtake et al.

(10) Patent No.: US 6,978,602 B2
(45) Date of Patent: Dec. 27, 2005

(54) ENGINE EXHAUST CLEANING DEVICE

(75) Inventors: Makoto Ohtake, Yokohama (JP); Junichi Kawashima, Yokosuka (JP); Naoya Tsutsumoto, Yokohama (JP); Terunori Kondo, Yokohama (JP); Takao Inoue, Yokohama (JP); Toshimasa Koga, Yokohama (JP)

(73) Assignee: Nissan Motor Co., Ltd., Kanagawa (JP)

( * ) Notice: Subject to any disclaimer, the term of this patent is extended or adjusted under 35 U.S.C. 154(b) by 65 days.

(21) Appl. No.: 10/700,517

(22) Filed: Nov. 5, 2003

(65) Prior Publication Data

US 2004/0123589 A1 Jul. 1, 2004

(30) Foreign Application Priority Data

Dec. 25, 2002 (JP) ..... P2002-374873

(51) Int. Cl.[7] ..... F01N 3/00

(52) U.S. Cl. ..... 60/295; 60/285; 60/297; 60/311

(58) Field of Search ..... 60/285, 295, 297, 60/311

(56) References Cited

U.S. PATENT DOCUMENTS

| | | | | |
|---|---|---|---|---|
| 4,535,588 | A * | 8/1985 | Sato et al. | 60/286 |
| 6,598,387 | B2 * | 7/2003 | Carberry et al. | 60/297 |
| 6,802,180 | B2 * | 10/2004 | Gabe et al. | 60/285 |
| 2003/0145582 | A1 * | 8/2003 | Bunting et al. | 60/297 |

FOREIGN PATENT DOCUMENTS

| | | | |
|---|---|---|---|
| EP | 0411445 | A | 2/1991 |
| EP | 1146216 | A | 10/2001 |
| EP | 1176290 | A | 1/2002 |
| JP | 06-058137 | A | 3/1997 |

* cited by examiner

*Primary Examiner*—Thomas Denion
*Assistant Examiner*—Diem Tran
(74) *Attorney, Agent, or Firm*—Shinjyu Global IP Counselors, LLP

(57) ABSTRACT

An engine exhaust cleaning device is configured to prevent the temperature of a particulate matter filter (DPF) from rising sharply due to a reduction in the exhaust gas flow rate when a vehicle decelerates and shifts into idling operation during regeneration of the particulate matter filter. During regeneration of the particulate matter filter, the fuel cut (F/C) recovery engine speed used during deceleration is increased and the engine idling speed is increased for a prescribed amount of time when the engine idles.

13 Claims, 4 Drawing Sheets

ENGINE EXHAUST CLEANING DEVICE

BACKGROUND OF THE INVENTION

1. Field of the Invention

The present invention relates to an internal combustion engine exhaust cleaning device provided with a particulate matter filter that collects particulate matter (PM), i.e., substances made up of particles, from exhaust gas in an exhaust passage. More particularly, the present invention relates to a technology for regenerating such a particulate matter filter.

2. Background Information

As disclosed in Japanese Laid-Open Patent Publication No. 6-58137, there already exists the idea of arranging a particulate matter filter in an exhaust passage and, according to a prescribed regeneration timing, executing regeneration processing whereby the temperature of the filter is raised so that the particulate matter collected in the filter is removed by combustion.

In view of the above, it will be apparent to those skilled in the art from this disclosure that there exists a need for an improved engine exhaust cleaning device. This invention addresses this need in the art as well as other needs, which will become apparent to those skilled in the art from this disclosure.

SUMMARY OF THE INVENTION

It has been discovered that when the vehicle decelerates and shifts into idling operation during regeneration of the particulate matter filter, the combustion of the particulate matter continues but the exhaust gas flow rate decreases. This reduction of the exhaust gas flow rate causing a reduction in the cooling of the gas. As a result, the filter temperature rises sharply and sometimes exceeds the allowable temperature limit for the particulate matter filter.

In view of this problem with the prior art, one object of the present invention is to make it possible to suppress sharp rises in the filter temperature when the engine shifts into idling operation during regeneration of the particulate matter filter.

The present invention is configured such that when regeneration of the particulate matter filter is in progress, the idling speed of the engine is raised above the normal idling speed that is used when regeneration is not in progress.

By increasing the idling speed used when the engine shifts into idling operation during regeneration, the present invention suppresses the reduction in exhaust gas flow rate and secures the required gas cooling, thus enabling a sharp rise in filter temperature to be suppressed.

In view of the above and in accordance with one aspect of the present invention, an engine exhaust cleaning device is provided that basically comprises a particulate matter filter, a regeneration processing section and an idling speed raising section. The particulate matter filter is configured to collects particulate matter from exhaust gas in an exhaust passage. The regeneration processing section is configured to execute regeneration processing that raises temperature of the particulate matter filter to remove the particulate matter collected in the particulate matter filter by combustion of the particulate matter collected in the particulate matter filter. The idling speed raising section is configured to raise the engine idling speed when the engine idles during the regeneration processing of the particulate matter filter by the regeneration processing section.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
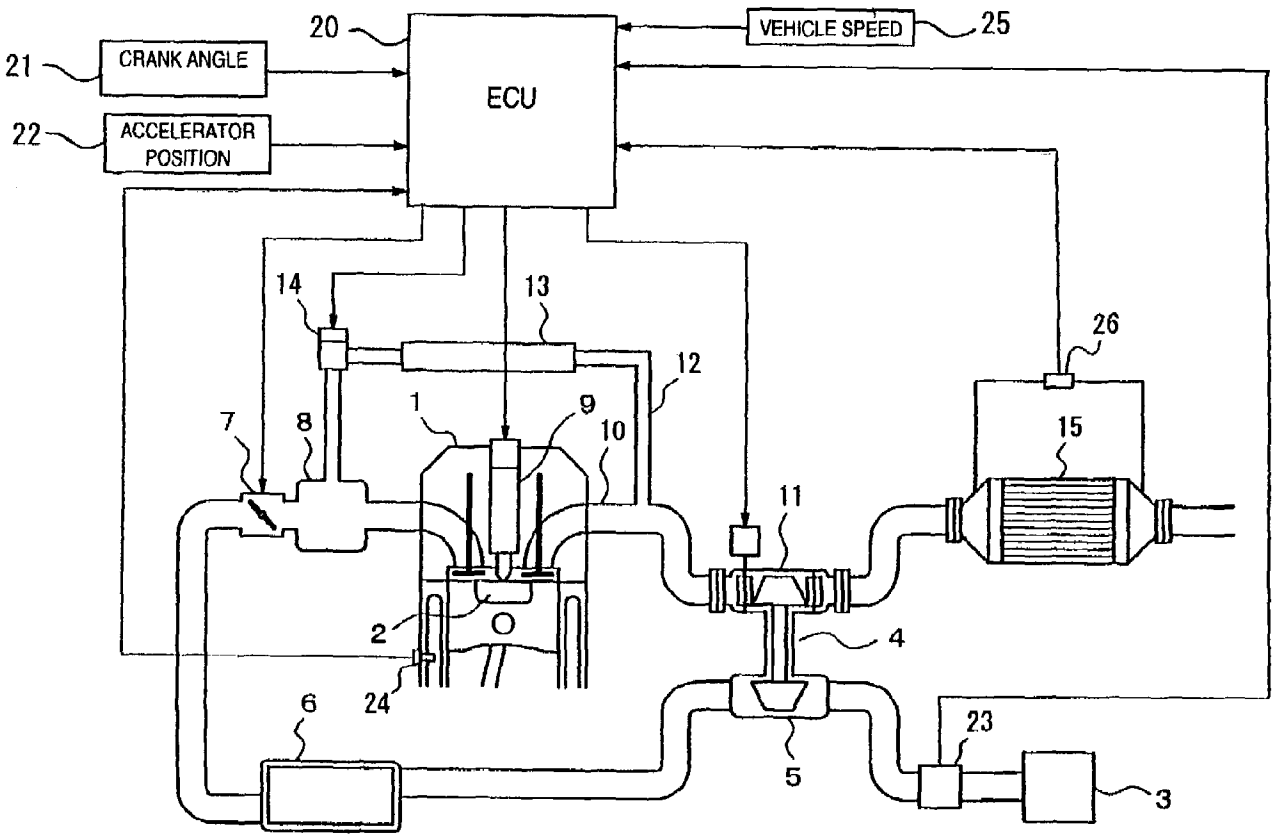
FIG. 1 is a schematic system diagram for a diesel engine equipped with an exhaust gas cleaning device in accordance with one embodiment of the present invention.

Referring initially to FIG. 1, a schematic diagram of a direct injection diesel engine 1 is illustrated in accordance with a first embodiment of the present invention. The diesel engine 1 is preferable used in an automobile. The diesel engine 1 is well known in the art. Since diesel engines are well known in the art, the precise structure of the diesel engine 1 will not be discussed or illustrated in detail herein.

Regarding the engine main body, the diesel engine 1 includes an engine block with a plurality of combustion chambers 2 formed by pistons that are movably mounted in cylinders of the engine block. Air is taken into the combustion chambers 2 of the cylinders of the diesel engine 1 after passing through an air cleaner 3 of the air intake system. The air intake system has a variable nozzle supercharger 4, an air compressor 5 driven by the variable nozzle supercharger 4, an intercooler 6, a throttle valve 7, and an air intake manifold 8. The fuel supply system is provided with a plurality of fuel injection valves 9 into which high-pressure fuel is directed from a common rail (not shown) and from which fuel can be injected into the combustion chambers 2 of the cylinders at any desired timing. Fuel is injected (main injection) during the compression stroke of each cylinder and combusted by compression ignition. After combustion, the exhaust gas is discharged through an exhaust manifold 10 of the exhaust system and an exhaust turbine 11 driven by the variable nozzle supercharger 4. A portion of the exhaust gas is drawn from the exhaust manifold 10 into an EGR passage 12 and passes through an EGR cooler 13 and an EGR valve 14 before being recirculated into the intake manifold 8.

In order to clean the particulate matter out of the exhaust gas discharged from the diesel engine 1, an exhaust gas cleaning device is provided that includes a diesel particulate filter (DPF) 15 for collecting particulate matter is provided in the exhaust passage downstream of the exhaust turbine 11. The exhaust gas cleaning device can be used with particulate matter filters other than the diesel particulate filter 15 mentioned herein. Thus, the term "particulate matter filter" is a generic term that includes, but is not limited to, a diesel particulate filter.

As the diesel particulate filter 15 collects particulate matter and the quantity of accumulated particulate matter increases, the exhaust resistance increases and the operating performance degrades. Thus, the exhaust gas cleaning device is also provided with a regenerating device, which comprises an electronic control unit or ECU 20 and a plurality of sensors. The regenerating device is configured and arranged to remove the particulate matter collected in the particulate matter filter 15 by combustion of the particulate matter collected in the particulate matter filter 15. In other words, the regenerating device regenerates the diesel particulate filter 15 by combustion of the particulate matter collected in the diesel particulate filter 15. More specifically, the regenerating device determines a prescribed regeneration timing and then executes the regeneration processing that raises temperature of the diesel particulate filter 15.

The electronic control unit 20, which forms a part of the regenerating device of the exhaust gas cleaning device, detects if a prescribed regeneration timing has been reached based on an accumulated particulate matter quantity and/or various engine operating conditions. If the electronic control unit 20 determines that the prescribed regeneration timing has been reached, then the electronic control unit 20 initiates the regeneration process to regenerate the diesel particulate filter 15 by raising the temperature of the exhaust gas, which in turn raises the temperature of the diesel particulate filter 15 to combust the particulate matter collected in the diesel particulate filter 15.

The diesel particulate filter 15 has a honeycomb monolith made of ceramic or the like. The basic structure of the diesel particulate filter 15 is well known in the art. Since diesel particulate filters are well known in the art, the precise structure of the diesel particulate filter 15 will not be discussed or illustrated in detail herein.

The electronic control unit 20 preferably includes a microcomputer with a regenerative particulate filter control program that controls various engine components, including, but not limited to, the variable nozzle supercharger 4, the throttle valve 7, the fuel injectors 9 and the EGR valve 14 as discussed below. The electronic control unit 20 can also include other conventional components such as an input interface circuit, an output interface circuit, and storage devices such as a ROM (Read Only Memory) device and a RAM (Random Access Memory) device. The microcomputer of the electronic control unit 20 is programmed to control the regeneration of the particulate filter 12. The memory circuit stores processing results and control programs are run by the processor circuit. The electronic control unit 20 is operatively coupled to various sensors that are used to execute the regenerative processing of the diesel particulate filter 15. The internal RAM of the electronic control unit 20 stores statuses of operational flags and various control data. The internal ROM of the electronic control unit 20 stores various operations as needed and/or desired. It will be apparent to those skilled in the art from this disclosure that the precise structure and algorithms for electronic control unit 20 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The processing steps of the electronic control unit 20 that carry out the function of the regeneration process constitute a regeneration processing device or section (i.e., a device for raising the temperature of the diesel particulate filter 15. More specifically, this regeneration processing device or section raises the temperature of the exhaust gas flowing into the diesel particulate filter 15 to raise the temperature of the diesel particulate filter 15. For example, the particulate matter can be combusted by controlling one or more of the following engine operating conditions: (1) retarding the fuel injection timing (main fuel injection) of the fuel injection valves 9; (2) executing a post injection that comprises an additional injection of fuel from the fuel injection valves 9 during the power stroke or the exhaust stroke; (3) reducing the opening degree of the throttle valve 7 (reduced intake air quantity leads to a richer fuel-air mixture and a higher exhaust gas temperature); (4) reducing the supercharging pressure of the variable nozzle supercharger 4 (reduced intake air quantity leads to a richer fuel-air mixture and a higher exhaust gas temperature); and/or (5) increasing the EGR rate of the EGR valve 14.

Consequently, the engine control unit 20 that controls the operation of the fuel injection valves 9, the throttle valve 7, the variable nozzle supercharger 4, and the EGR valve 14 receives one or more control signals from the following items: (1) a crank angle sensor 21 that generates a crank angle signal that is synchronized with the engine rotation and can be used to detect the engine speed; (2) an accelerator position sensor 22 (which includes an idle switch that turns ON when the accelerator is OFF) that detects the accelerator position (accelerator pedal depression amount); (3) an air flow meter 23 that detects the intake air quantity; (4) a coolant temperature sensor 24 that detects the temperature of the engine coolant; (5) a vehicle speed sensor 25 that detects the vehicle speed; and (6) a pressure difference sensor 26 that detects the pressure at the front and rear of the diesel particulate filter 15 in order to detect the pressure loss across the diesel particulate filter 15. Since the crank angle sensor 21 can be used to detect the engine speed and the accelerator position sensor 22 that detects the accelerator position (accelerator pedal depression amount) can be used to estimate load, the sensor 21 and 22 together with the processing of the engine control unit 20 form an exhaust gas flow rate detecting section configured to detect or estimate an exhaust gas flow rate flowing through the diesel particulate filter 15.

In this embodiment, the engine control unit 20 detects the pressure difference across the diesel particulate filter 15 based on the signal from a pressure difference sensor 26. Thus, the engine control unit 20 estimates the accumulated quantity of particulate matter (PM) based on the detected pressure difference. The engine control unit 20 determines the regeneration timing based on the estimated accumulated particulate matter quantity and executes regeneration processing when the engine control unit 20 determines that the regeneration timing has been reached.

Figure 2:
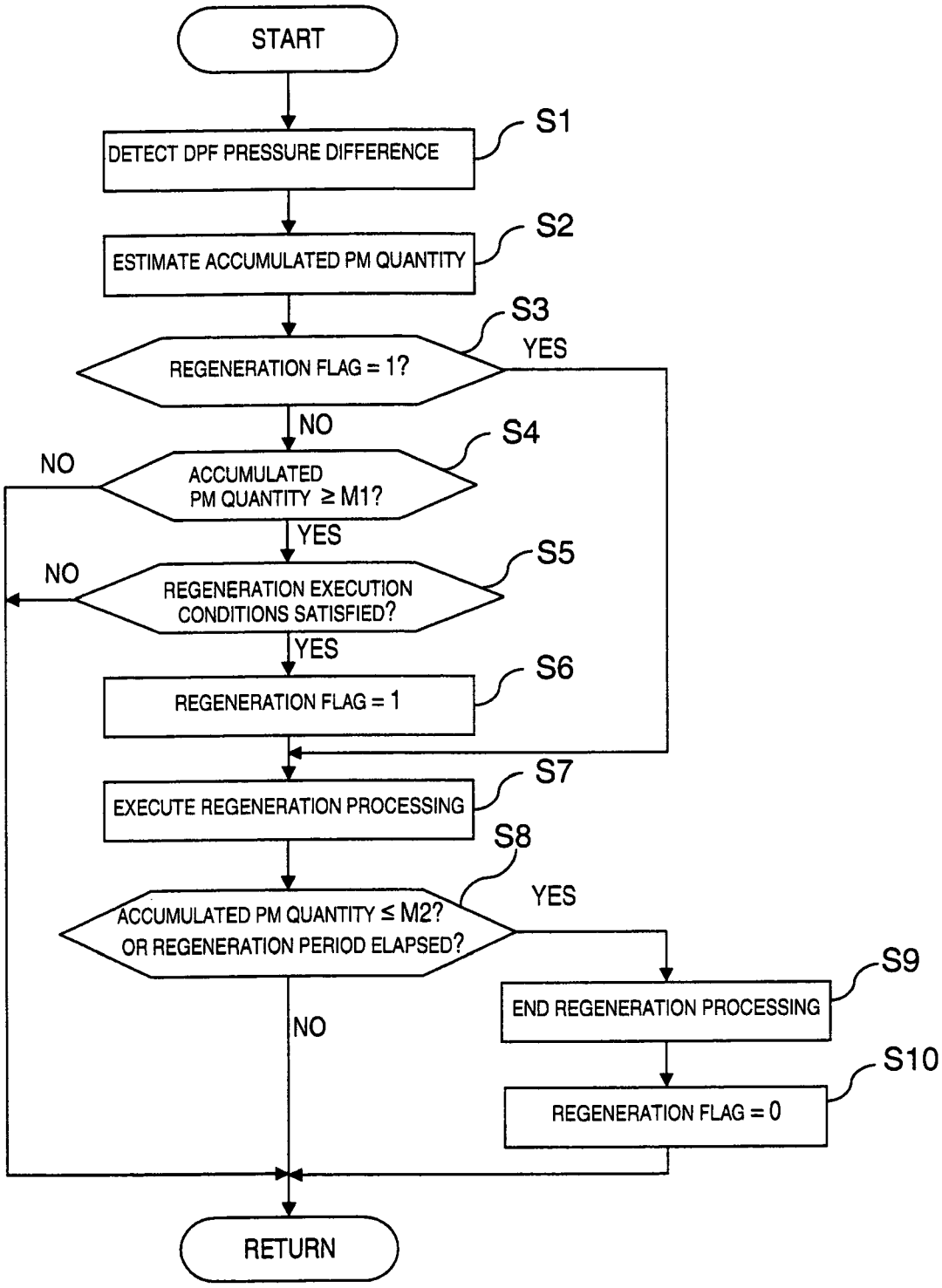
FIG. 2 is a flowchart showing a diesel particulate filter regeneration control routine for the diesel particulate filter used in the diesel engine illustrated in FIG. 1 in accordance with the present invention.

The specific details of the controls executed by the engine control unit 20 will now be described using the flowcharts of FIGS. 2 and 3. First, the flowchart of FIG. 2 illustrates the regeneration processing by the engine control unit 20 for executing the diesel particulate filter regeneration control routine, which is repeated each time that a prescribed amount of time elapses.

In step S1, the engine control unit 20 reads in the signal from the pressure difference sensor 26 and determines the pressure difference across the diesel particulate filter 15.

In step S2, the engine control unit 20 refers to a table for estimating the accumulated particulate matter quantity from the diesel particulate filter (DPF) pressure difference, and thus, the engine control unit 20 estimates the accumulated particulate matter quantity based on the diesel particulate filter pressure difference detected in step S1. However, the diesel particulate filter pressure difference also varies depending on the exhaust gas flow rate. Thus, although omitted in the flowcharts, it is preferred to detect the engine speed and load (i.e., using one or more control signals from the sensors 21 and 21) to estimate the exhaust gas flow rate based on these values using a prescribed map or the like. Then, the engine control unit 20 adjusts the estimated accumulated particulate matter quantity in accordance with the estimated exhaust gas flow rate.

In step S3, the engine control unit 20 checks the value of the regeneration flag and proceeds to step S4 if the regeneration flag is 0 (regeneration not in progress).

In step S4, the engine control unit 20 compares the accumulated particulate matter quantity estimated in step S2 with a prescribed value M1 for determining if the accumulated particulate matter quantity is greater than or equal to M1. The prescribed value M1 is used for determining the regeneration timing for initiating regeneration of the diesel particulate filter 15. This section or step (step S4) of the processing by the engine control unit 20 corresponds to a portion of the accumulated particulate quantity detecting device or section of the present invention.

If the accumulated particulate matter quantity is less than M1, the engine control unit 20 determines that it is not time to regenerate the diesel particulate filter 15 and returns to the beginning of the control routine. If the accumulated particulate matter quantity is greater than or equal to M1, the engine control unit 20 determines that it is time to regenerate the diesel particulate filter 15 (regeneration required) and proceeds to step S5.

In step S5, the engine control unit 20 determines if the current operating conditions satisfy the regeneration execution conditions (i.e., if the engine operating state is such that regeneration is possible). If the regeneration execution conditions are satisfied (e.g., if the engine is not idling and the engine is operating at somewhat high-speed or high-load conditions or the vehicle speed is high), the engine control unit 20 proceeds to step S6 to start regeneration processing. This section or step (step S5) and the prior section or step (step S4) of the processing by the engine control unit 20 correspond to the regeneration timing determining device or section of the present invention.

In step S6, the engine control unit 20 sets the regeneration flag to 1 and proceeds to step S7. As a result, in subsequent executions of the main routine, the engine control unit 20 will obtain a result of "Yes" in step S3 and proceed directly from step S3 to step S7 because the regeneration flag will have a value of 1.

In step S7, in order to regenerate the diesel particulate filter 15, the engine control unit 20 executes regeneration processing that serves to raise the temperature of the diesel particulate filter 15 (i.e., raises the temperature of the exhaust gas flowing into the diesel particulate filter 15) and thus, remove the particulate matter accumulated in the diesel particulate filter 15 by combusting the particulate matter accumulated in the diesel particulate filter 15. More specifically, the temperature of the exhaust gas is raised such that the temperature inside the diesel particulate filter 15 rises to a temperature from which the particulate matter can be combusted such that the particulate matter accumulated in the diesel particulate filter 15 is removed by combustion.

The temperature of the exhaust gas is raised by controlling one or more engine components such as retarding the fuel injection timing (main fuel injection) of the fuel injection valves 9, executing a post injection that comprises an additional injection of fuel from the fuel injection valves 9 during the power stroke or the exhaust stroke, reducing the opening degree of the throttle valve 7, reducing the supercharging pressure of the variable nozzle supercharger 4, and/or increasing the EGR rate of the EGR valve 14. When this regeneration processing is executed, it is preferred for the engine control unit 20 to set a target regeneration processing temperature and, based on the target regeneration processing temperature, set or feedback control the fuel injection timing (main injection timing), the post injection timing/quantity, the throttle value opening degree, the supercharging pressure, and/or the EGR rate.

In step S8, in order to determine if prescribed regeneration ending conditions (complete regeneration conditions) are satisfied, the engine control unit 20 compares the latest accumulated particulate matter quantity with a prescribed value M2 (M2<M1) used for determining complete regeneration and determines if the accumulated particulate matter quantity is less than or equal to M2. Alternatively, it is also acceptable for the engine control unit 20 to determine, instead, if a prescribed regeneration time period has elapsed.

If the accumulated particulate matter quantity is greater than M2 (or if the prescribed regeneration time period has not elapsed), the engine control unit 20 determines that the regeneration is not complete and returns to the start of the control routine to continue the regeneration processing.

If the accumulated particulate matter quantity is found to be less than or equal to M2 (or if the prescribed regeneration time period is found to have elapsed) in step S8, the engine control unit 20 determines that the regeneration is complete and proceeds to step S9. The sections or steps S8 and S4 of the processing by the engine control unit 20 correspond to a portion of the regeneration timing determining device or section of the present invention.

In step S9, the engine control unit 20 ends the regeneration processing. More specifically, the parameters whose values were changed in step S7 in order to execute regeneration processing are all returned to their original values. Then, in step S10, the engine control unit 20 resets the regeneration flag to 0 and returns to the start of the control routine. Thus, the sections or steps S3–S10 of the processing by the engine control unit 20 correspond to the regeneration processing device or section of the present invention.

Figure 3:
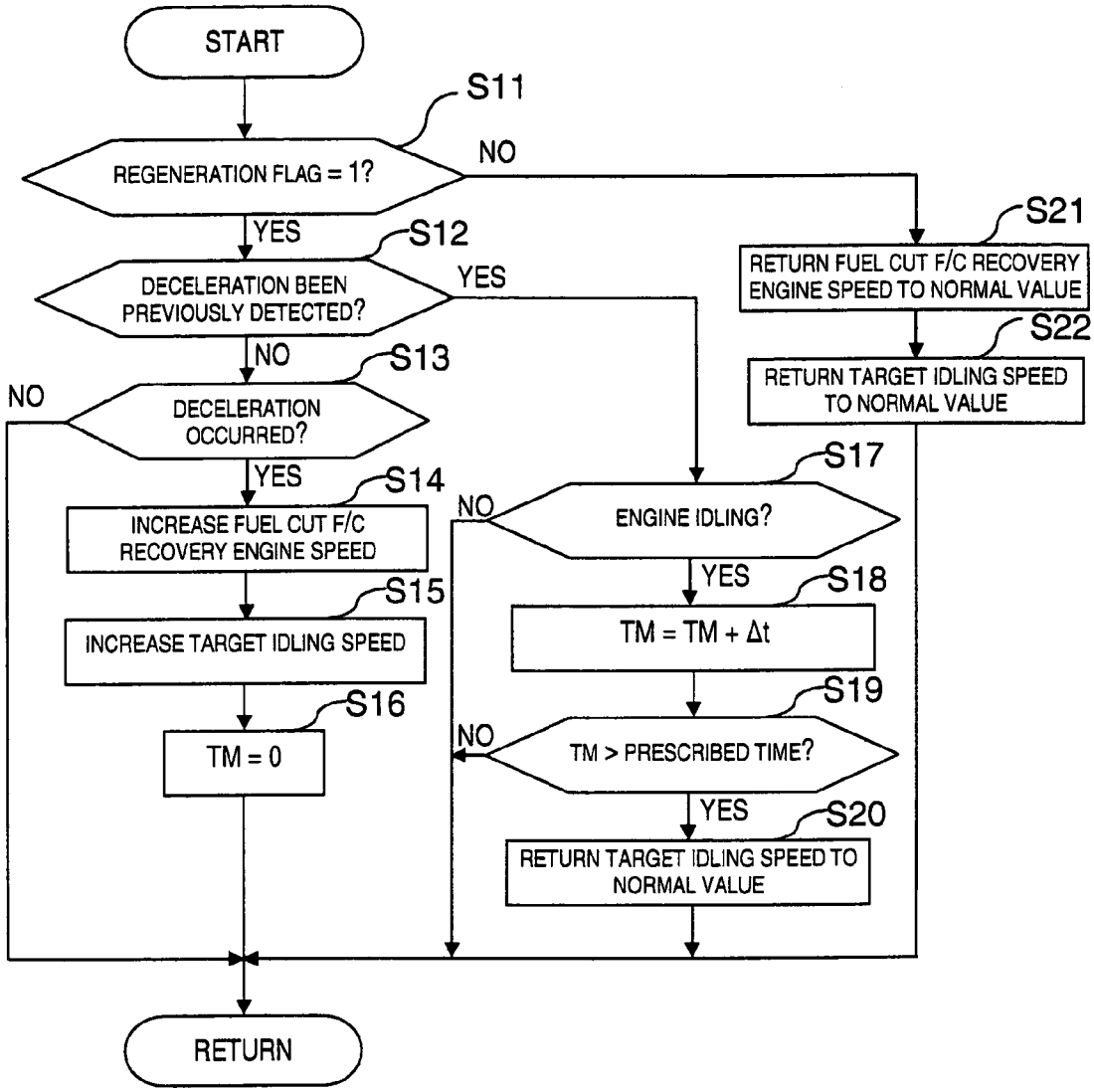
FIG. 3 is a flowchart of the deceleration and idling control processes that are executed during regeneration of the diesel particulate filter by the exhaust gas cleaning device in accordance with the present invention.

Now referring to FIG. 3, the flowchart of FIG. 3 illustrates the deceleration and idle control routine executed by the engine control unit 20, which is repeated in parallel with the routine of FIG. 2 each time that a prescribed amount of time elapses.

In step S11, the engine control unit 20 determines if the regeneration flag is set to 1 (i.e., if regeneration is in progress). If the regeneration flag is 0 (regeneration not in progress), the engine control unit 20 sets the fuel cut (F/C) recovery engine speed to the normal value in step S21 and sets the target engine idling speed to the normal value in step S22 before returning to the start of the routine.

If the regeneration flag is 1 (regeneration in progress), the engine control unit 20 proceeds to step S12.

In step S12, the engine control unit 20 checks if deceleration has already been detected since regeneration started and proceeds to step S13 if deceleration has not already been detected.

In step S13, the engine control unit 20 determines if deceleration has occurred or is occurring. More specifically, it determines, for example, if the idle switch has changed from OFF to ON as determined by the accelerator position sensor 22. It is also acceptable to determining if deceleration has occurred or is occurring based on the amount of decline in the engine speed. If deceleration is determined to have occurred or is occurring, the engine control unit 20 executes steps S14 to S16.

In step S14, the fuel cut (F/C) recovery engine speed is set to a value higher than the normal value (i.e., value used when regeneration is not in progress). This section or step (step S14) of the processing by the engine control unit 20 corresponds to the fuel cut recovery engine speed increasing device or section of the present invention.

In step S15, the target engine idling speed is set to a value higher than the normal value (i.e., value used when regeneration is not in progress). This section or step (step S15) of the processing by the engine control unit 20 corresponds to the engine idling speed raising device or section of the present invention.

In step S16, the engine control unit 20 resets to 0 a timer TM for measuring the amount of time that idling has continued during regeneration and returns to the start of the routine.

When deceleration occurs, fuel cutting is triggered (i.e., fuel injection by the fuel injection valves 9 is stopped) when the idle switch is ON and the engine speed is greater than or equal to a prescribed fuel cut engine speed. Afterwards, fuel cut recovery (ending fuel cutting and resuming fuel injection) is executed when the accelerator turns ON (idling switch OFF) or when the engine speed becomes equal to or less than the fuel cut recovery engine speed. By increasing the fuel cut recovery engine speed, fuel cut recovery is made to occur at a comparatively high engine speed when the fuel is cut due to shifting into deceleration operation during regeneration. Thus, since the engine can be held at a higher speed when it shifts from deceleration operation to idling operation, the decrease in the exhaust gas flow rate can be suppressed and a sharp rise in the diesel particulate filter temperature can be prevented.

When deceleration ends and the engine shifts to idling, the engine control unit 20 compares the actual engine speed to the target engine idling speed during idling and executes feedback control of the fuel injection quantity of the fuel injection valves 9 (and/or the opening degree of the throttle valve 7) in such a manner that the actual engine speed matches the target engine idling speed. By increasing the target engine idling speed, the engine idling speed that results when the engine shifts from deceleration operation to idling operation during regeneration can be increased. As a result, the decrease in the exhaust gas flow rate can be suppressed and a sharp rise in the diesel particulate filter temperature can be prevented.

After it has been determined that deceleration has occurred during regeneration, the engine control unit 20 will proceed to step S17 because it will obtain a result of "Yes" in step S12.

In step S17, the engine control unit 20 determines of the engine is idling. More specifically, it determines that the engine is idling when, for example, the idling switch is ON and the engine speed is within a prescribed range defined by the target engine idling speed.

If the engine is not idling, the engine control unit 20 returns to the start of the routine. If the engine is idling, the engine control unit 20 proceeds to step S18.

In step S18, the engine control unit 20 increases the value of the timer TM by the control cycle period ($\Delta t$) of the main routine in order to calculate the amount of time that idling operation has continued ($TM=TM+\Delta t$). Then the engine control unit 20 proceeds to step S19.

In step S19, the engine control unit 20 determines if the value of the timer TM has exceeded a prescribed time period (several minutes).

If the amount of time that idling operation has continued is less than or equal to a prescribed amount of time, the engine control unit 20 returns to the start of the routine so that the increased idling speed can be continued by maintaining the increased target engine idling speed.

Conversely, if the amount of time that idling operation has continued greater than the prescribed amount of time, the engine control unit 20 proceeds to step S20 where it returns the target engine idling speed to the normal value and ends the increased idling speed before returning to the start of the routine. Since there is no more risk of the exhaust gas temperature rising sharply, the engine idling speed is returned to normal to suppress degradation of the fuel economy.

Figure 4:
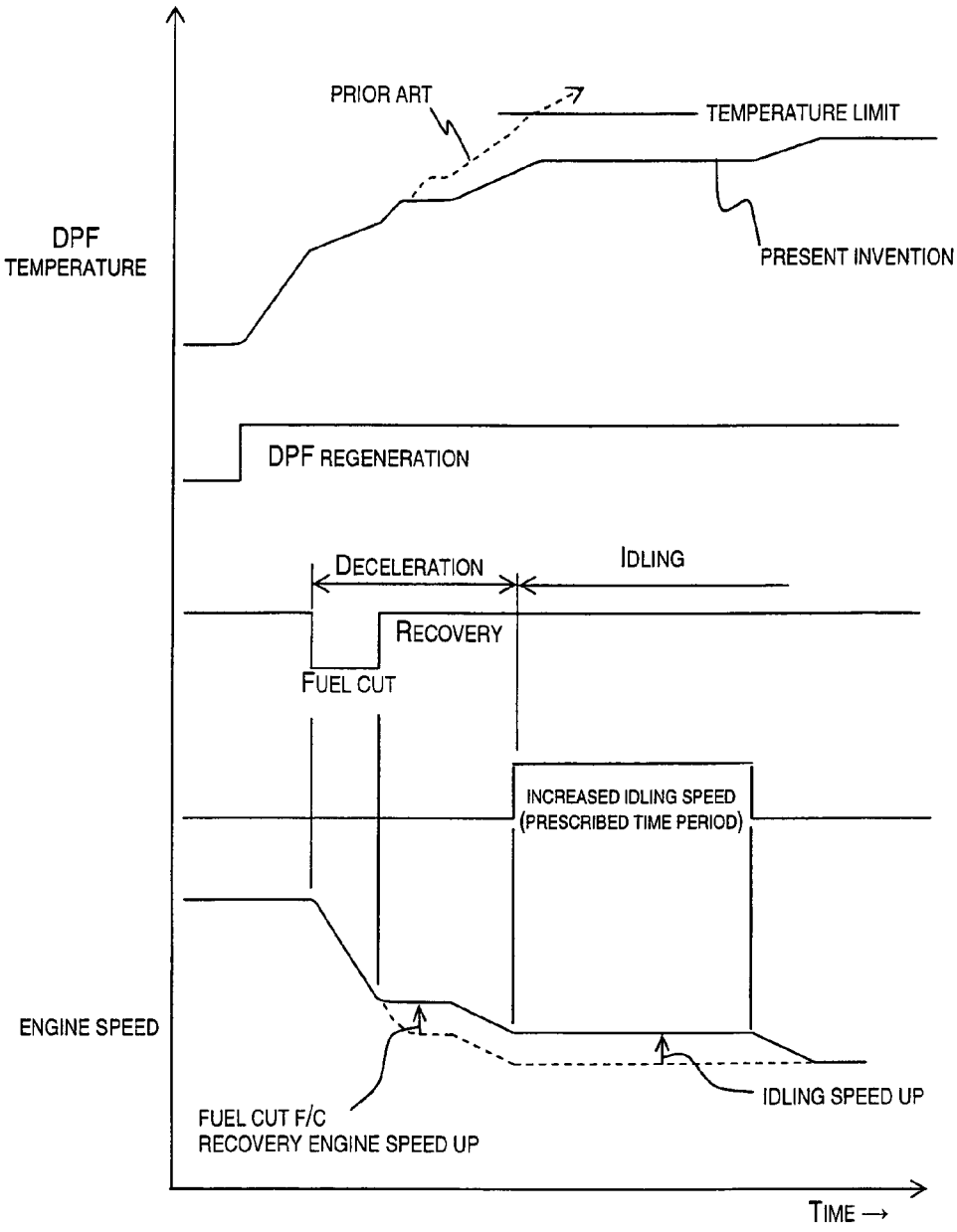
FIG. 4 is a time chart illustrating a case in which the vehicle decelerates and the engine shifts into idling operation during regeneration of the diesel particulate filter by the exhaust gas cleaning device in accordance with the present invention.

A case in which the vehicle decelerates and shifts into idling operation during regeneration is explained using the time chart of FIG. 4.

When the engine shifts into deceleration operation, fuel cutting is executed until the engine speed decreases to a prescribed fuel cut (F/C) recovery engine speed and then fuel cut recovery is executed. When fuel cutting occurs after a prescribed regeneration timing has been reached and regeneration of the diesel particulate filter 15 has begun, the fuel cut recovery engine speed is increased to a value higher than the normal value. As a result, the engine speed can be held at a comparatively high speed when deceleration occurs while regeneration is in progress.

When the engine shifts from deceleration operation to idling operation, the engine idling speed is feedback-controlled by increasing and decreasing the fuel injection quantity so that the engine speed matches the target engine idling speed. During regeneration, the target engine idling speed is increased to a value higher than the normal value for a prescribed amount of time after idling operation begins. As a result, the engine speed (idling speed) during idling operation can be maintained at a comparatively high speed.

By increasing the fuel cut recovery engine speed and the target engine idling speed, the engine speed is kept comparatively high and decreases in the exhaust gas flow rate are suppressed. As a result, a sharp rise in the temperature of the diesel particulate filter 15 can be prevented. Meanwhile, the diesel particulate filter 15 can be regenerated reliably and quickly once regeneration has started because regeneration can be continued without interruption even if the vehicle decelerates and the engine shifts into idling operation.

When a prescribed amount of time has elapsed after shifting into idling operation, the risk of the diesel particulate filter 15 experiencing a sharp rise in temperature disappears and degradation of the fuel economy can be prevented by ending the processing that increases the idling speed.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2002-374873. The entire disclosure of Japanese Patent Application No. 2002-374873 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An engine exhaust cleaning device comprising:

a particulate matter filter configured to collects particulate matter from exhaust gas in an exhaust passage;

a regeneration processing section configured to execute regeneration processing that raises temperature of the particulate matter filter to remove the particulate matter collected in the particulate matter filter by combustion of the particulate matter collected in the particulate matter filter; and an idling speed raising section configured to set a target engine idling speed to a higher value than a normal engine idling speed when a deceleration of a vehicle is detected during the regeneration processing of the particulate matter filter by the regeneration processing section to raise the engine idling speed when the engine idles during the regeneration processing.

2. The engine exhaust cleaning device recited in claim 1, wherein the regeneration processing section is further configured to increase the temperature of the exhaust gas by adjusting at least one of the following: a timing of a main fuel injection used for controlling the engine torque, a timing and quantity of a post fuel injection executed after the main fuel injection, a cross sectional area of an air intake passage opening, a supercharging pressure produced by a supercharger, and a flow rate of exhaust gas recirculated from the an exhaust passage to an air intake passage.

3. The engine exhaust cleaning device received in claim 1, wherein the regeneration processing section includes an accumulated particulate quantity detecting section configured to detect the quantity of particulate matter that has accumulated within the particulate matter filter to determine regeneration timing to regenerate the particulate matter filter when an accumulated particulate quantity reaches a first prescribed quantity.

4. The engine exhaust cleaning device recited in claim 3, wherein the accumulated particulatye detecting section includes a filter pressure difference detecting sensor configured to detect a pressure difference across the particulate matter filter, an exhaust gas flow rate detecting section configured to detect an exhaust gas flow rate, and an accumulated particulate quantity computing section configured to compute the accumulated particulate quantity that has accumulated in the particulate matter filter based on the filter pressure difference detected by the filter pressure differences detecting sensor and the exhaust gas flow rate detected by the exhaust gas flow rate detecting section, and the regeneration processing section is further configured to determine the regeneration timing to regenerate the particulate matter filter by comparing the accumulated particulate quantity computed by the accumulated particulate quantity computing section with the first prescribed quantity.

5. The engine exhaust cleaning device recited in claim 1, wherein the regeneration processing section is further configured to increase the temperature of the exhaust gas by adjusting at least one of the following: a timing of a main fuel injection used for controlling the engine torque, a timing and quantity of a post fuel injection executed after the main fuel injection, a cross sectional area of an air intake passage opening, a supercharging pressure produced by a supercharger, and a flow rate of exhaust gas recirculated from the an exhaust passage to an air intake passage.

6. An engine exhaust cleaning device comprising:

a particulate matter filter configured to collects particulate matter from exhaust gas in an exhaust passage;

a regeneration processing section configured to execute regeneration processing that raises temperature of the particulate matter filter to remove the particulate matter collected in the particulate matter filter by combustion of the particulate matter collected in the particulate matter filter;

an idling speed raising section configured to raise the engine idling speed when the engine idles during the regeneration processing of the particulate matter filter by the regeneration processing section; and a fuel cut recovery engine speed processing section configured to raise a fuel cut recovery engine speed during the regeneration processing of the particulate matter filter by the regeneration processing section.

7. The engine exhaust cleaning device recited in claim 6, wherein the idling speed raising section is further configured to raise the engine idling speed for a prescribed amount of time when the engine idles during the regeneration processing of the particulate matter filter, and after the prescribed amount of time has elapsed, returns the engine idling speed to a normal idling speed value, when the engine idles during the regeneration processing of the particulate matter filter.

8. The engine exhaust cleaning device recited in claim 7, wherein the regeneration processing section is further configured to increase the temperature of the exhaust gas by adjusting at least one of the following: a timing of a main fuel injection used for controlling the engine torque, a timing and quantity of a post fuel injection executed after the main fuel injection, a cross sectional area of an air intake passage opening, a supercharging pressure produced by a supercharger, and a flow rate of exhaust gas recirculated from the an exhaust passage to an air intake passage.

9. The engine exhaust cleaning device recited in claim 7, wherein the regeneration processing section includes an accumulated particulate quantity detecting section configured to detect the quantity of particulate matter that has accumulated within the particulate matter filter to determine regeneration timing to regenerate the particulate matter filter when an accumulated particulate quantity reaches a first prescribed quantity.

10. The engine exhaust cleaning device recited in claim 9, wherein the accumulated particulate quantity detecting section includes a filter pressure difference detecting sensor configured to detect a pressure difference across the particulate matter filter, an exhaust gas flow rate detecting section configured to detect an exhaust gas flow rate, and an accumulated particulate quantity computing section configured to compute the accumulated particulate quantity that has accumulated in the particulate matter filter based on the filter pressure difference detected by the filter pressure difference detecting sensor and the exhaust gas flow rate detected by the exhaust gas flow rate detecting section, and the regeneration processing section is further configured to determine the regeneration timing to regenerate the particulate matter filter by comparing the accumulated particulate quantity computed by the accumulated particulate quantity computing section with the first prescribed quantity.

11. The engine exhaust cleaning device recited in claim 9, wherein the regeneration processing section is further configured to end the regeneration processing of the particulate matter filter by the regeneration processing section by comparing the accumulated particulate quantity with a second prescribed quantity that is less than the first prescribed quantity.

12. An engine engine exhaust cleaning device comprising:

a particulate matter filter configured to collects particulate matter from exhaust gas in an exhaust passage;

a regeneration processing section configured to execute regeneration processing that raises temperature of the particulate matter filter to remove the particulate matter collected in the particulate matter filter by combustion of the particulate matter collected in the particulate matter filter; and an idling speed raising section configured to raise the engine idling speed when the engine idles during the regeneration processing of the particulate matter filter by the regeneration processing section, the idling speed raising section being further configured to raise the engine idling speed for a prescribed amount of time when the engine idles during the regeneration processing of the particulate matter filter, and after the prescribed amount of time has elapsed, returns the engine idling speed to a normal idling speed value, when the engine idles during the regeneration processing of the particulate matter filter.

13. An engine exhaust cleaning device comprising:

particulate matter collecting means for collecting particulate matter from exhaust gas in an exhaust passage;

regeneration processing means for executing regeneration processing that raises temperature of the particulate matter collecting means to remove the particulate matter collected in the particulate matter collecting means by combustion of the particulate matter collected in the particulate matter collecting means; and idling speed raising means for setting a target engine idling speed to a higher value than a normal engine idling speed when a deceleration of a vehicle is detected during the regeneration processing of the particulate matter filter by the regeneration processing means, and for raising the engine idling speed when the engine idles during the regeneration processing.

* * * * *